US011879305B2

(12) United States Patent
Hovda et al.

(10) Patent No.: US 11,879,305 B2
(45) Date of Patent: Jan. 23, 2024

(54) BEHIND CASING CEMENTING TOOL

(71) Applicant: CONOCOPHILLIPS COMPANY, Houston, TX (US)

(72) Inventors: Lars Hovda, Tananger (NO); James C. Stevens, Houston, TX (US); Dan Mueller, Houston, TX (US); Amal Phadke, Houston, TX (US); Praveen Gonuguntla, San Antonio, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/406,969

(22) Filed: Aug. 19, 2021

(65) Prior Publication Data

US 2022/0056783 A1 Feb. 24, 2022

Related U.S. Application Data

(60) Provisional application No. 63/112,427, filed on Nov. 11, 2020, provisional application No. 63/112,448, filed on Nov. 11, 2020, provisional application No. 63/112,440, filed on Nov. 11, 2020, provisional application No. 63/067,599, filed on Aug. 19, 2020.

(51) Int. Cl.

| | |
|---|---|
| ***E21B 33/14*** | (2006.01) |
| ***E21B 41/00*** | (2006.01) |
| ***E21B 37/00*** | (2006.01) |
| ***E21B 33/13*** | (2006.01) |

(52) U.S. Cl.

CPC ..... *E21B 33/14* (2013.01); *E21B 33/13* (2013.01); *E21B 37/00* (2013.01); *E21B 41/0078* (2013.01)

(58) Field of Classification Search

CPC ..... E21B 33/1243

See application file for complete search history.

(56) References Cited

U.S. PATENT DOCUMENTS

| | | | | |
|---|---|---|---|---|
| 3,129,759 | A | 4/1964 | Tillman | |
| 4,892,144 | A * | 1/1990 | Coone | E21B 33/1295 166/134 |
| 5,967,229 | A * | 10/1999 | Basso | E21B 23/06 166/187 |
| 9,637,977 | B2 * | 5/2017 | Giroux | E21B 33/14 |

(Continued)

OTHER PUBLICATIONS

Ferg, T.—"Novel Techniques to More Effective Plug and Abandonment Cementing Techniques", 2011, Society of Petroleum Engineers Artic and Extreme Environments Conference, Moscow, SPE 148640; 13 pgs.

(Continued)

*Primary Examiner* — William D Hutton, Jr.
*Assistant Examiner* — Avi T Skaist
(74) *Attorney, Agent, or Firm* — ConocoPhillips Company

(57) ABSTRACT

The invention relates to a cementing tool for use in oil and gas well decommissioning operations, in particular so called perforate, wash and cement procedures. The tool (1) is designed for running in a well on drill string and for jetting cement through previously formed perforations in the casing (10) to fill the outer annulus (9) with cement. The tool (1) has a cylindrical wall (3) which is formed from steel (11) and elastomeric (5) elements, whereby it is expandable between a first diameter in which it may be run down the well and a second, larger diameter deployed during cementing operations.

10 Claims, 2 Drawing Sheets

(56) References Cited

U.S. PATENT DOCUMENTS

| | | | | |
|---|---|---|---|---|
| 2005/0011678 | A1* | 1/2005 | Akinlade | E21B 33/1243 166/279 |
| 2010/0230101 | A1 | 9/2010 | Rayssiguier et al. | |
| 2013/0248187 | A1* | 9/2013 | Al-Anazi | E21B 33/138 166/212 |
| 2015/0267501 | A1 | 9/2015 | Al-Gouhi | |
| 2020/0040707 | A1 | 2/2020 | Watts et al. | |
| 2020/0173249 | A1 | 6/2020 | Fairweather | |

OTHER PUBLICATIONS

International Search Report for PCT/US2021/046759 dated Dec. 1, 2021; 3 pgs.

* cited by examiner

BEHIND CASING CEMENTING TOOL

CROSS-REFERENCE TO RELATED APPLICATIONS

This application is a non-provisional application which claims benefit under 35 USC § 119(e) to U.S. Provisional Application Ser. No. 63/067,599 filed Aug. 19, 2020, entitled "Jet-Type Perforation-Wash-Cement Parameterization," U.S. Provisional Application Ser. No. 63/112,427 filed Nov. 11, 2020, entitled "Behind Casing Wash and Cement," U.S. Provisional Application Ser. No. 63/112,440 filed Nov. 11, 2020, entitled "Behind Casing Cementing Tool" and U.S. Provisional Application Ser. No. 63/112,448 filed Nov. 11, 2020, entitled "Setting a Cement Plug", each of which is incorporated herein in its entirety.

STATEMENT REGARDING FEDERALLY SPONSORED RESEARCH

None.

FIELD OF THE INVENTION

This invention relates to the process of cementing behind the casing of a well, for example in a so-called perf, wash cement well decommissioning operation.

BACKGROUND OF THE INVENTION

In a process for placing cement in the annulus of a well, normally the annulus between casing and wellbore (e.g., in a perf, wash cement well abandonment operation), there are three distinct steps:

- Opening the casing (explosive, mechanical, abrasive or melt based perforation)
- Washing the annulus between casing and wellbore
- Displacing in plugging material (e.g., cement).

Following the wash, the setting of plugging material (cement) behind the casing is the next step in the process. There are at least 4 alternative techniques for displacing the annulus content (wash fluid or "spacer fluid") to cement but the one with which this application is concerned involves a cementing head with nozzles which create "jets" of cement, or pulses of energy in cement, which force cement through apertures in the casing and displace the existing fluid in the annulus behind/outside the casing, thereby creating a cement bond in the outer annulus.

This process will be referred to a "cementing" and the plugging material as "cement" but it is to be understood that it is not necessarily limited to the use of cement and any suitable plugging material could be employed; the terms "cement" and "cementing" should be understood accordingly.

The jet technique for cementing is, in the experience of the applicant, the most effective technique. Nonetheless, jet cementing procedures have not always been successful and the applicant has done a considerable amount of development to investigate through physical experiments, field work and CFD analysis what factors and parameters, including pressures, flow rates, etc., affect the success of a downhole cementing operation. Some of this work is described in patent application number US2020/040707A1. The contents of US2020/040707A1 are incorporated herein by reference.

The physical design of the cementing tool has been the focus of more recent efforts by the applicant, culminating in the filing of two patent applications on cementing tool geometry, of which this is one. The contemporaneously filed patent application entitled Behind Casing Wash and Cement in the name of the same applicant and with the same inventors is hereby incorporated herein by reference.

BRIEF SUMMARY OF THE DISCLOSURE

The inventors believe, based on actual perf, wash, cement jobs in the North Sea and also on extensive computational fluid dynamics (CFD) work, that one important factor in the success of the cementing operation is the diameter of the cementing tool in relation to the internal diameter ("drift diameter") of the casing.

The inventors have found through both practical experience and through CFD modelling work that reducing the gap between the cementing tool and the annulus dramatically influences the energy of the flow behind the casing and the ability of the cement effectively to displace the existing fluid (wash fluid, normally drilling mud) in the outer annulus. Displacement of the fluid is important because, if the cement mixes substantially with wash fluid then an effective cement bond may not be achieved.

In general, when performing downhole operations, it is desirable to minimize the outer diameter of tools in order to reduce the chances of debris, such as steel burr or swarf from a perforation operation, becoming lodged in the gap between the tool and casing. This can result in the tool becoming jammed in the casing (so called "stuck pipe") and can be expensive to remedy.

There is therefore a conflict between making the outer diameter of cementing tool as large as possible, whilst keeping the risk of stuck pipe to an acceptable level.

A potential problem with using a relatively large diameter cementing tool arises when the casing is deformed at some point above the region to be cemented, thereby creating in effect a smaller pathway for the tool. Cause for such a restriction can be geological events like subsidence or effective horizontal stress larger than the collapse capacity of the casing. There may be other reasons why it is required to be able to pass the tool through a narrower section of tubing or casing than the section to be treated by the tool (typically referred to as a patch), for example if the tool is to be passed through a section of concentric smaller diameter tubing above a larger diameter region for cementing (typically established by window milling).

The cementing tool is, in essence, a hollow cylinder with apertures in it which function as nozzles for creating outwardly directed jets of cement when pressurized cement is passed into the tool. The tool is run on drillstring and is rotated as well as being moved axially such that the jets of cement create pulses of pressure in the casing which are transmitted through perforations in the casing and energize the fluid in the outer annulus, thereby displacing it to cement.

The inventors have conceived an improved design of cementing tool which has a variable outer diameter, such that it can be passed down the casing in a narrow configuration and, when the time comes for cement to be injected, its diameter can be increased. In this way, the tool may be passed through restrictions in the casing etc, and if stuck pipe should occur during a cementing operation, the diameter of the tool may be reduced to free the tool.

The cement tool may have an inner core of steel which contains its activation and de-activation functions. After activation the design cementing pressure drop (normally 2500 Psi/17.24 MPa) will energize an outer sleeve and expand the overall OD to a given preset maximum. The sleeve may be constructed by steel reinforced elastomers similar to a BOP annular element. As the cement operation is concluded the differential pressure over the cement tool will be zero and the outer diameter reduced again.

According to the invention a tool and method, along with optional features, are provided as defined in the appended claims.

In this application the term drift diameter refers to the maximum diameter of object which can pass freely down a certain specification of casing. Whilst the internal diameter of the casing may vary slightly, the drift diameter provides a precise value for a given standard casing size. For example the typical drift diameter for 9⅝ inch (24.45 cm) casing is 8.5 inches (21.59 cm).

In this application, the word "perf" or "perforation" shall, unless the context requires otherwise, mean any aperture in a casing through which cement or wash fluid may pass and is not limited to apertures formed by an explosive charge, e.g. from a so-called "perf gun".

In connection with all aspects of the invention and their respective optional features, the casing diameter may be 10¾ inch (27.31 cm), 9⅝ inch (24.45 cm) or 7¾ inch (19.69 cm) diameter, optionally 10¾ inch (27.31 cm) or 9⅝ inch (24.45 cm) diameter or in the range 5½" to 12" (13.97 cm to 30.48 cm).

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
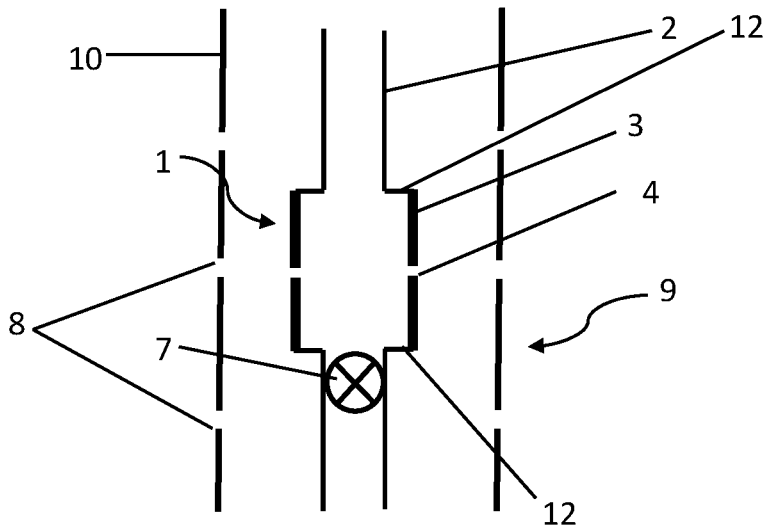
FIG. 1 is a schematic longitudinal cross section of a cementing tool within a wellbore casing.

Referring firstly to FIG. 1, a cementing tool 1 is shown in highly schematic form. The aspect ratio of the real tool would be considerably longer, but it is illustrated in this way for clarity. The tool 1 comprises in essence a hollow cylindrical shape with two apertures 4 in the cylindrical wall 3. These apertures 4 are lined with a wear resistant material to avoid them being worn away when cement is jetted through them—this is not shown in the drawing but is in itself conventional.

The tool 1 is attached to drill string 2 on which it would be run into a well. Beneath the tool 1 (distally with respect to the surface) is a valve 7 which may be operated by dropping a ball down the drill pipe. The casing 10 of the well is shown. The region of casing 10 shown in FIG. 1 has been prepared for abandonment by being perforated, and the perforations are shown at 8. Behind or outside the casing is an annulus indicated generally at 9; the outer boundary of the annulus would be the rock formation, though this is omitted in FIG. 1 for clarity. As is conventional and would be understood by the person of ordinary skill in this art, the purpose of the cementing tool is to jet cement into the annular region between the cement tool and the casing and then into the outer annulus 9 through the perforations 8 in the casing 10.

FIG. 1 shows a relatively large distance between the casing 10 and the cylindrical wall 3 of the tool 1. In this example the outer diameter of the tool is 5.5 inches (13.97 cm) and the inner diameter or, more strictly, the drift diameter of the casing is 8.5 inches (21.59 cm). At some point above the tool 1 (proximally with respect to the surface) there may be deformed regions of the casing 1, or other obstructions in the casing 1, which effectively reduce the drift and it is desirable to be able to run the cementing tool 1 past these obstructions. In some cases, there may be narrower concentric tubing or casing above (proximally of) the region to be cemented, through which the cementing tool must be passed.

Figure 2:
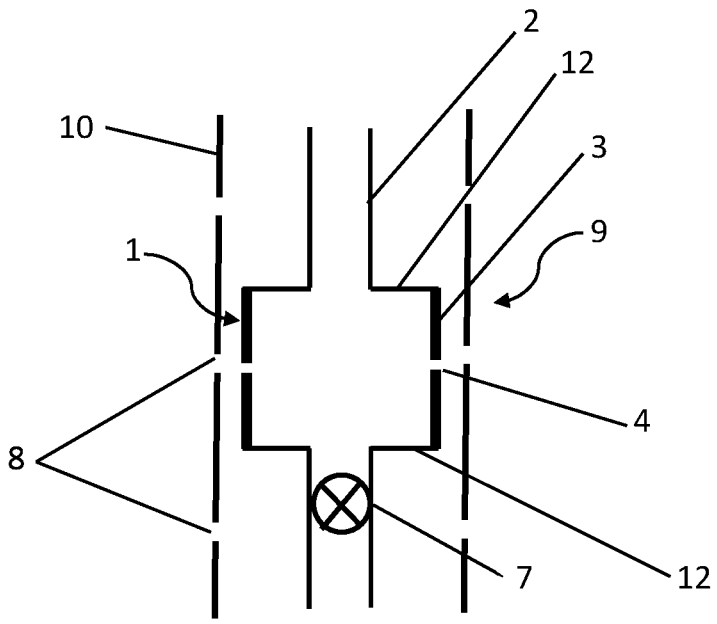
FIG. 2 is a view similar to FIG. 1 showing the cementing tool in an expanded state.

Turning now to FIG. 2, this shows the same casing and tool as FIG. 1, but with the tool 1 in an expanded state. The diameter of the cylindrical wall 3 has been increased so as to reduce the size of the annular region between the tool and the casing. It has been found that this increases the energy of cement pulses in the annulus between the tool and casing and thereby increases the energy of cement pulses in the outer annulus 9. This results in the cement more efficiently displacing existing fluid in the outer annulus 9, resulting in better quality cement and cement bond to casing and formation.

Before delivering cement, the valve 7 distal of the tool is closed; cement being pumped down the drill string into the tool 1 increases the pressure within the tool, which has the effect of increasing the diameter of the tool as well as jetting the cement through the nozzles 4. The expandable structure of the cylindrical wall of the tool is described below. Annular shoulders 12 of elastomeric material above and below the expandable wall 3 connect it to the drill string 2, allowing for expansion of the cylindrical wall 3.

Figure 3:
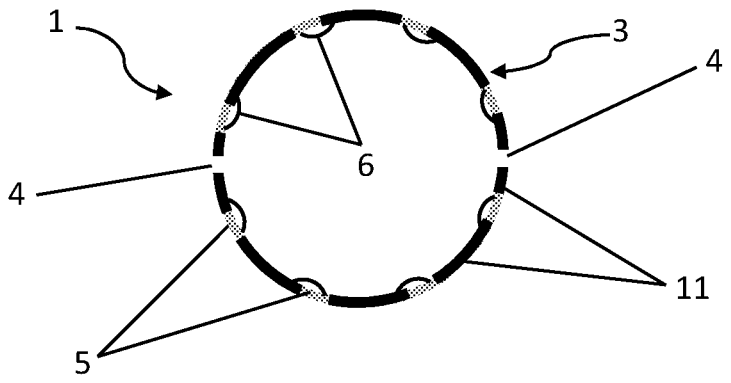
FIG. 3 is a schematic transverse cross section through the un-expanded cementing tool of FIG. 1, on an enlarged scale.

Referring now to FIG. 3, a transverse cross section of the cement tool 1 is shown, in its un-expanded state. The casing is not shown in this view. The cylindrical wall 3 of the tool 1 comprises steel elements 11 alternating with elastomeric elements 5. The steel and elastomer elements 11, 5 are securely fastened together by well-known vulcanization techniques. In FIG. 3, the elastomeric elements 5 are in a relaxed state. Steel wires 6 connect the steel elements 11 across the elastomeric elements 5. In FIG. 3, the steel wires 6 are slack. The nozzles 4 can be seen to be formed in two of the steel elements 11.

Figure 4:
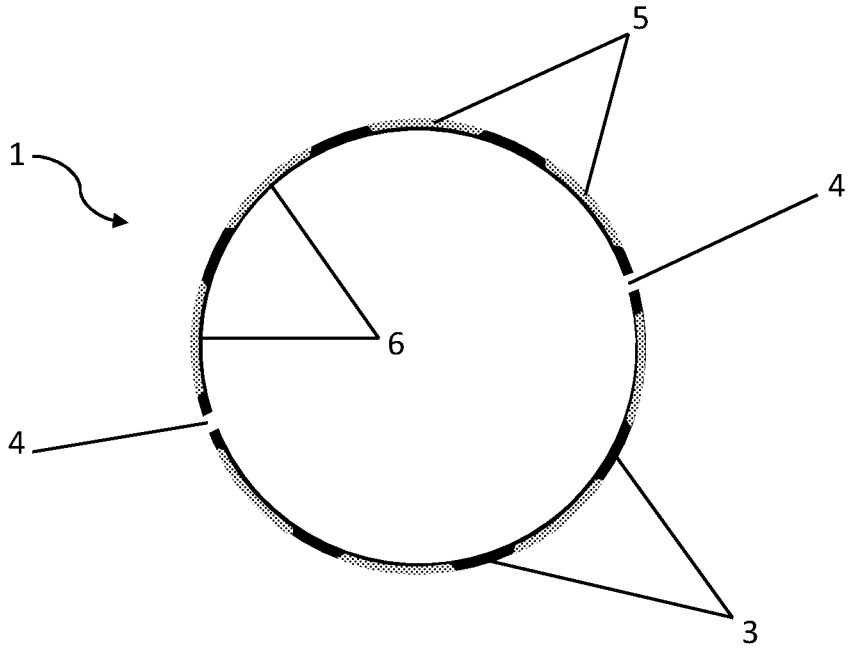
FIG. 4 is a schematic transverse cross section through the expanded cementing tool of FIG. 2, on an enlarged scale.

Turning now to FIG. 4, which is similar in most respects to FIG. 3, the tool 1 is shown in an expanded state. The elastomeric elements 5 are stretched such that the overall diameter of the tool is increased. The wires 6 extending across the elastomeric regions 5 limit the degree of expansion and thereby allow the tool to be designed to expand to a predetermined diameter when pressurized by cement. The circumferential tension to stretch the elastomeric elements 5 is provided by the pressurized cement being delivered through the tool and creating a pressure difference between the interior and exterior of the cylindrical wall 3.

It is believed to be important to determine the maximum outer diameter with reasonable accuracy. As detailed in the contemporaneous filing to this one, entitled "behind casing wash and cement", the difference in size between casing drift diameter and cementing tool outer diameter can be significant. For the non-expandable tool described in that patent application, the range for this diameter difference is considered to be from 0.25 to 1.0 inches (0.64 to 2.54 cm). However, with an expandable tool, the risk of stuck pipe may be mitigated by the ability to reduce the tool diameter by reducing pressure, so a range of 0.1 to 0.75 inches (0.25 to 1.90 cm) of diameter difference may be preferred, with an optional range of perhaps 0.25 to 0.5 inches (0.64 to 1.27 cm).

The tool may be used in any size of casing but normally 9⅝ inch (24.45 cm), 7¾ inch (18.42 cm) or 10¾ inch (27.31 cm) outer diameter casings are used.

It should be understood that these diagrams are highly simplified. Steel and elastomer expandable downhole tools are available for different purposes, e.g. forming selectively activatable packing elements, and could be adapted for a downhole cementing tool.

In a modification, the elastomeric material may extend around the whole circumference, with steel members embedded in in a similar manner to a car tyre. Nozzle apertures would then be formed through both steel and elastomer. Other systems for expanding the tool also may be possible, such as a hydraulically actuated mechanism allowing the external diameter to be adjusted selectively from the surface in a continuous manner, rather than having two specific diameters and no other possible diameters.

Some or all of the outer profile of the tool may be of variable diameter. Ideally the region of the tool in which the nozzles are located has variable diameter. The remainder of the length of the tool may also have variable diameter, in particular the region above or proximal of the nozzles. CFD and practical work using designs of fixed diameter cementing tools with substantially the same diameter over their full length have shown that maximizing overall tool diameter is very effective. It is speculated that the region of tool above or proximal of the nozzles may form a choke, boosting the pressure and energy of the flow in the annulus between tool and casing. An expandable region of the tool above (proximally of) the cement nozzles may be provided. This expandable region could have a diameter slightly smaller than the drift diameter of the casing when deployed, whilst the region of the tool in which nozzles are located could have a fixed smaller diameter.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication date after the priority date of this application. Incorporated references are listed again here for convenience:

Ferg, T., et al "Novel Techniques to More Effective Plug and Abandonment Cementing Techniques", Society of Petroleum Engineers Artic and Extreme Environments Conference, Moscow, 18-20 Oct. 2011 (SPE #148640).

US2020/040707A1 (ConocoPhillips)

The invention claimed is:

1. A method of cementing an annulus exterior to a perforated region of casing in an oil or gas well to be abandoned, the method comprising:

a. delivering to the perforated region a cementing tool comprising a body in which at least one nozzle aperture is formed, the tool being delivered in a first configuration in which the body has a first outer diameter;

b. reconfiguring the tool such that the body has a second, larger, outer diameter, wherein the degree of expansion of the tool is limited such that the tool is designed to expand to a pre-set maximum diameter less than the diameter of the casing when pressurized so as to reduce the size of an annular region between the tool and the casing; and c. delivering cement through the said at least one nozzle aperture into the annular region between the tool and the casing and then through perforations in the casing and into the exterior annulus.

2. The method according to claim 1, wherein the reconfiguration of the tool is actuated by pressure of cement being supplied to the tool.

3. The method according to claim 1 wherein the second diameter is selected from about 0.1, 0.2, 0.25, 0.3, 0.4, 0.5, 0.6, 0.7, and 0.75 inches smaller than the drift diameter of the casing.

4. The method according to claim 1 wherein the first diameter is selected from about 1, 1.5, 2, 2.5, 3, 3.5, and 4.0 inches smaller than the drift diameter of the casing.

5. A method of cementing an annulus exterior to a perforated region of casing in an oil or gas well to be abandoned, the method comprising:

a. delivering to the perforated region a cementing tool comprising: a generally cylindrical body with an interior void; at least one nozzle aperture formed in the body for passing cement from the interior void to an exterior of the body; the body, or portion of it that has said at least one nozzle aperture formed therein, having a selectively adjustable outer diameter;

b. increasing the outer diameter of the body or the adjustable portion thereof to a pre-set maximum diameter less than the diameter of the casing so as to reduce the size of an annular region between the tool and the casing; and c. delivering cement from the cementing tool into the annular region between the tool and the casing and then through perforations in the casing and into the exterior annulus.

6. The method according to claim 5, wherein at least one nozzle aperture is formed in a portion of the body having the selectively adjustable outer diameter.

7. The method according to claim 5, wherein the body or the selectively adjustable portion thereof is designed to change its diameter in response to fluid pressure in the interior void.

8. The method according to claim 5, wherein the body or the selectively adjustable portion thereof is designed to increase its diameter in response to a positive pressure difference between the interior void and the exterior of the body, and to reduce its diameter automatically in the absence of the positive pressure difference.

9. The method according to claim 5, wherein the body or the selectively adjustable portion thereof comprises a plurality of rigid elements alternating with resiliently flexible elements around the circumference of the body.

10. The method according to claim 5, wherein the body or the selectively adjustable portion thereof has a first diameter and a second diameter, the first diameter selected from about 1, 1.5, 2, 2.5, 3, 3.5, and 4.0 inches smaller than the drift diameter of the casing and the second diameter is selected from about 0.1, 0.2, 0.25, 0.3, 0.4, 0.5, 0.6, 0.7, and 0.75 inches smaller than the drift diameter of the casing.

* * * * *